US011438692B2

(12) United States Patent
Zhang et al.

(10) Patent No.: US 11,438,692 B2
(45) Date of Patent: Sep. 6, 2022

(54) DIRECTIONAL SOUND GENERATION METHOD AND DEVICE FOR AUDIO APPARATUS, AND AUDIO APPARATUS

(71) Applicant: GOERTEK INC., Shandong (CN)

(72) Inventors: Chuantao Zhang, Shandong (CN); Qing Wang, Shandong (CN)

(73) Assignee: GOERTEK INC., Shandong (CN)

( * ) Notice: Subject to any disclaimer, the term of this patent is extended or adjusted under 35 U.S.C. 154(b) by 0 days.

(21) Appl. No.: 17/309,142

(22) PCT Filed: Dec. 29, 2018

(86) PCT No.: PCT/CN2018/125229

§ 371 (c)(1),
(2) Date: Apr. 29, 2021

(87) PCT Pub. No.: WO2020/087745

PCT Pub. Date: May 7, 2020

(65) Prior Publication Data

US 2022/0014845 A1 Jan. 13, 2022

(30) Foreign Application Priority Data

Oct. 29, 2018 (CN) ..... 201811270158.5

(51) Int. Cl.
*H04R 1/40* (2006.01)

(52) U.S. Cl.
CPC ..... *H04R 1/403* (2013.01); *H04R 1/406* (2013.01)

(58) Field of Classification Search
CPC ..... H04R 1/403; H04R 1/406; H04R 1/323; H04R 1/34; H04R 2201/025
See application file for complete search history.

(56) References Cited

U.S. PATENT DOCUMENTS

| | | | | |
|---|---|---|---|---|
| 11,086,597 | B2 * | 8/2021 | Yuan | H04N 7/142 |
| 2011/0135125 | A1 | 6/2011 | Zhan et al. | |
| 2014/0003611 | A1 | 1/2014 | Mohammad et al. | |
| 2015/0023524 | A1 | 1/2015 | Shigenaga et al. | |
| 2016/0021478 | A1 | 1/2016 | Katagiri | |

(Continued)

FOREIGN PATENT DOCUMENTS

| | | | |
|---|---|---|---|
| CN | 104035065 | A | 9/2014 |
| CN | 104301664 | A | 1/2015 |

(Continued)

*Primary Examiner* — Jason R Kurr
(74) *Attorney, Agent, or Firm* — LKGlobal | Lorenz & Kopf, LLP

(57) ABSTRACT

The present disclosure discloses a method and apparatus for directional sound emission of an audio device, and an audio device. The method includes: by using the spherical microphone array, determining a spatial position of a sound-emission sound source of a user; according to a relationship among the spatial position of the sound-emission sound source of the user, a center position of the audio device and an opening position of the loudspeaker, determining a horizontal compensatory angle and a vertical compensatory angle of the opening direction of the loudspeaker relative to the spatial position of the user; and adjusting the opening direction of the loudspeaker, so that the horizontal compensatory angle and the vertical compensatory angle are made to be zero.

6 Claims, 6 Drawing Sheets

(56) References Cited

U.S. PATENT DOCUMENTS

| | | | | |
|---|---|---|---|---|
| 2020/0103939 | A1* | 4/2020 | Hsu | G06F 1/1632 |
| 2020/0221225 | A1* | 7/2020 | Pompei | H04R 1/406 |
| 2020/0329308 | A1* | 10/2020 | Tateishi | G01S 3/8006 |

FOREIGN PATENT DOCUMENTS

| | | | |
|---|---|---|---|
| CN | 107170440 | A | 9/2017 |
| CN | 206658288 | U | 11/2017 |
| CN | 108107407 | A | 6/2018 |
| CN | 108551619 | A | 9/2018 |
| CN | 109068234 | A | 12/2018 |
| WO | 2008051661 | A1 | 5/2008 |

* cited by examiner

DIRECTIONAL SOUND GENERATION METHOD AND DEVICE FOR AUDIO APPARATUS, AND AUDIO APPARATUS

CROSS-REFERENCE TO RELATED APPLICATIONS

This Application is a U.S. National-Stage entry under 35 U.S.C. § 371 based on International Application No. PCT/CN2018/125229, filed Dec. 29, 2018 which was published under PCT Article 21(2) and which claims priority to Chinese Application No. 201811270158.5, filed Oct. 29, 2018, which are all hereby incorporated herein in their entirety by reference.

TECHNICAL FIELD

This Application pertains to a method and apparatus for directional sound emission of an audio device, and an audio device.

BACKGROUND

With the growth in the living standard, smart-home devices are becoming increasingly popular in everyday life. Smart audio devices, as one of them, are immensely popular, and the users have very high requirements on the sound effect of smart audio devices.

Currently, as restricted by the volume or price of product, most of the audio products in the market are single-loudspeaker products. In usage scenes, the audio devices are generally placed at a fixed position. Therefore, the area or direction of the optimum sound effect of the audio device is specific, and, if the user is not facing the direction of the sound emission of the loudspeaker of the audio device, the experience of sound effect is rather poor. In addition, other objects, desirable features and characteristics will become apparent from the subsequent summary and detailed description, and the appended claims, taken in conjunction with the accompanying drawings and this background.

SUMMARY

The present disclosure provides a method and apparatus for directional sound emission of an audio device, and an audio device, to solve the problem of conventional audio devices that the orientation of the loudspeaker is fixed.

One aspect of the present disclosure provides a method for directional sound emission of an audio device, wherein the audio device comprises a built-in loudspeaker whose opening direction is adjustable and a spherical microphone array, the spherical microphone array comprises a plurality of microphones that are spherically disposed, and the method for directional sound emission comprises: by using the spherical microphone array, determining a spatial position of a sound-emission sound source of a user; according to a relationship among the spatial position of the sound-emission sound source of the user, a center position of the audio device and an opening position of the loudspeaker, determining a horizontal compensatory angle and a vertical compensatory angle of the opening direction of the loudspeaker relative to the spatial position of the user, respectively; adjusting the opening direction of the loudspeaker, so that the horizontal compensatory angle and the vertical compensatory angle are made to be zero.

The method for directional sound emission according to the present disclosure, by using the spherical microphone array, can accurately determine the spatial position of the sound-emission sound source of the user; based on the position relationship among the spatial position of the sound-emission sound source of the user, the center position of the audio device and the opening position of the loudspeaker, can determine the horizontal compensatory angle and the vertical compensatory angle of the opening direction of the loudspeaker relative to the spatial position of the user; and, by adjusting the opening direction of the loudspeaker, so that the two compensatory angles are made to be zero, can realize the adjustment of the two degrees of freedom of the loudspeaker, which enables the opening direction of the loudspeaker to be aligned with the spatial position of the user in real time and accurately, and ensures that the user is within the area of the optimum sound effect of the audio device, thereby improving the acoustic experience of the user.

Another aspect of the present disclosure provides an apparatus for directional sound emission of an audio device, wherein the audio device comprises a built-in loudspeaker whose opening direction is adjustable, and a spherical microphone array, the spherical microphone array comprises a plurality of microphones that are spherically disposed, and the apparatus for directional sound emission comprises: a locating unit configured for, by using the spherical microphone array, determining a spatial position of a sound-emission sound source of a user; a calculating unit configured for, according to a relationship among the spatial position of the sound-emission sound source of the user, a center position of the audio device and an opening position of the loudspeaker, determining a horizontal compensatory angle and a vertical compensatory angle of the opening direction of the loudspeaker relative to the spatial position of the user, respectively; and an adjusting unit configured for adjusting the opening direction of the loudspeaker, so that the horizontal compensatory angle and the vertical compensatory angle are made to be zero.

The apparatus for directional sound emission according to the present disclosure, by using the locating unit to drive the spherical microphone array, can accurately determine the spatial position of the sound-emission sound source of the user; by using the calculating unit, based on the position relationship among the spatial position of the sound-emission sound source of the user, the center position of the audio device and the opening position of the loudspeaker, can determine the horizontal compensatory angle and the vertical compensatory angle of the opening direction of the loudspeaker relative to the spatial position of the user; and, by adjusting the opening direction of the loudspeaker with the adjusting unit, so that the two compensatory angles are made to be zero, can realize the adjustment of the two degrees of freedom of the loudspeaker, which enables the opening direction of the loudspeaker to be aligned with the spatial position of the user in real time and accurately, and ensures that the user is within the area of the optimum sound effect of the audio device, thereby improving the acoustic experience of the user.

Another aspect of the present disclosure provides an audio device, wherein the audio device comprises a built-in loudspeaker whose opening direction is adjustable, and a spherical microphone array, and further comprises a processor and a machine-readable storage medium that stores a machine-executable instruction, and by reading and executing the machine-executable instruction in the machine-readable storage medium, the processor is able to implement the method for directional sound emission of an audio device described above.

The audio device according to the present disclosure, by using the spherical microphone array, can accurately determine the spatial position of the sound-emission sound source of the user; based on the position relationship among the spatial position of the sound-emission sound source of the user, the center position of the audio device and the opening position of the loudspeaker, can determine the horizontal compensatory angle and the vertical compensatory angle of the opening direction of the loudspeaker relative to the spatial position of the user; and by adjusting the opening direction of the loudspeaker, so that the two compensatory angles are made to be zero, can realize the adjustment of the two degrees of freedom of the loudspeaker, which enables the opening direction of the loudspeaker to be aligned with the spatial position of the user in real time and accurately, and ensures that the user is within the area of the optimum sound effect of the audio device, thereby improving the acoustic experience of the user. Another aspect of the present disclosure provides a machine-readable storage medium, wherein the machine-readable storage medium stores a machine-executable instruction, and the machine-executable instruction, when executed by a processor, implements the method for directional sound emission of an audio device described above.

BRIEF DESCRIPTION OF THE DRAWINGS

The present invention will hereinafter be described in conjunction with the following drawing figures, wherein like numerals denote like elements, and.

DETAILED DESCRIPTION

Figure 1:
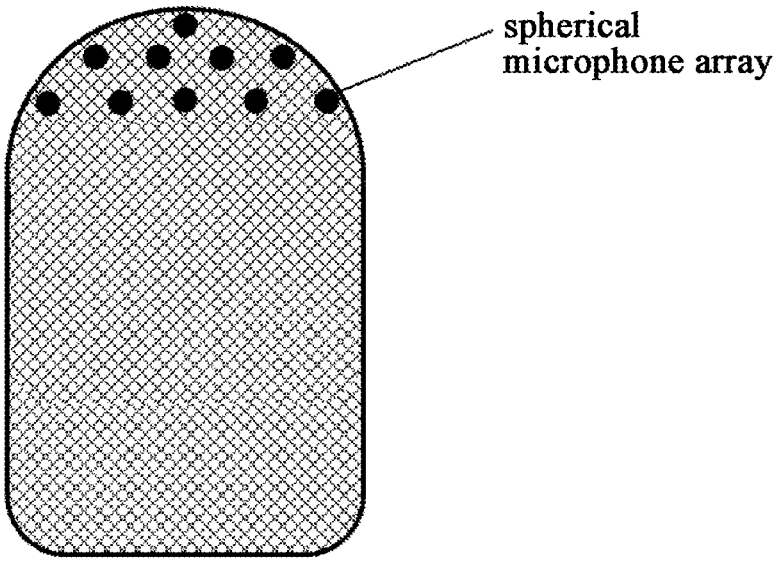
FIG. 1 is a schematic diagram of the audio device according to an embodiment of the present disclosure.

The following detailed description is merely exemplary in nature and is not intended to limit the invention or the application and uses of the invention. Furthermore, there is no intention to be bound by any theory presented in the preceding background of the invention or the following detailed description.

In order to make the objects, the technical solutions and the advantages of the present disclosure clearer, the embodiments of the present disclosure will be described below in further detail with reference to the drawings.

The embodiments of the present disclosure will be described below with reference to the drawings. However, it should be understood that the description is merely illustrative, and is not intended to limit the scope of the present disclosure. Moreover, in the following description, the description on well-known structures and techniques are omitted, in order to prevent unnecessary confusion of the concepts of the present disclosure.

The terms used herein are merely intended to describe the particular embodiments, and are not intended to limit the present disclosure. The words used herein "a", "an" and "the" should encompass the meanings of "a plurality of" and "multiple", unless explicitly indicated otherwise in the context. Moreover, the terms used herein "comprise" and "include" indicate the existence of the described features, steps, operations and/or components, but do not exclude the existence or addition of one or more other features, steps, operations or components.

All of the terms used herein (including technical and scientific terms) have the meanings generally understood by a person skilled in the art, unless defined otherwise. It should be noted that the terms used herein should be interpreted as having the meanings that are consistent in the context of the description, and should not be interpreted in a manner that is idealized or over-rigid.

The drawings show some block diagrams and/or flow charts. It should be understood that some of the blocks in the block diagrams and/or flow charts or a combination thereof may be implemented by computer program instructions. Those computer program instructions may be provided to a processor of a generic computer, a special-purpose computer or another programmable data processing device, whereby those instructions, when executed by the processor, may create a device for implementing the functions/operations that are described in those block diagrams and/or flow charts.

Therefore, the technique according to the present disclosure may be implemented in the form of hardware and/or software (including firmware, microcode and so on). In addition, the technique according to the present disclosure may be in the form of a computer program product on a computer-readable medium storing the instructions, wherein the computer program product may be used by or in combination with an instruction executing system. In the context of the present disclosure, the computer-readable medium may be any medium that can contain, store, transmit, propagate or transport the instructions. For example, the computer-readable medium may include but is not limited to an electric, magnetic, optical, electromagnetic, infrared or semiconductor system, apparatus, device or propagation medium. Particular examples of the computer-readable medium include: a magnetic storage device, such as a magnetic tape or a hard disk (HDD); an optical storage device, such as an optical disc (CD-ROM); a memory, such as a random access memory (RAM) or a flash memory; and/or a wired/wireless communication link.

To facilitate explaining the mode of the directional sound emission of the audio device according to the present embodiment, the composing structure of the audio device according to the present disclosure will be firstly described in the following embodiment, in which embodiment the audio device includes audio products such as a smart loudspeaker box.

The audio device according to the present embodiment comprises a built-in loudspeaker whose opening direction is adjustable and a spherical microphone array. As shown in FIG. 1, the spherical microphone array comprises a plurality of microphones that are spherically disposed. In the present embodiment, the opening direction of the built-in loudspeaker is adjusted by an adjusting mechanism.

Figure 4:
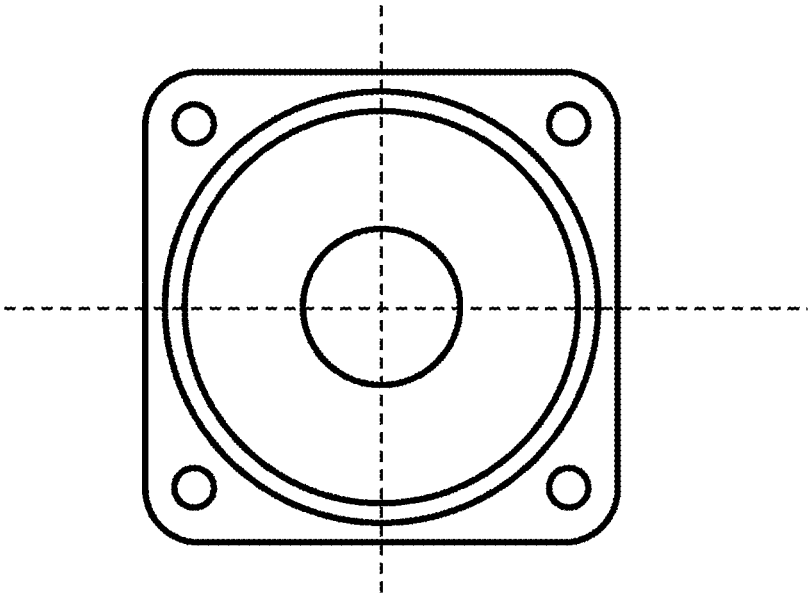
FIG. 4 is a schematic diagram of the opening position of the loudspeaker according to an embodiment of the present disclosure.

As shown in FIG. 4, in the present embodiment, the adjusting mechanism comprises a rotation motor 1 and an elevator motor 2. The rotation motor 1 may be sucked or fixed to a bottom plate of the audio device. A rotation support 3 is provided on the rotation motor 1. The rotation motor 1 may drive the rotation support 3 to rotate by 360° in the horizontal direction. The rotation support 3 comprises a supporting arm. A loudspeaker 4 is fixedly mounted in a loudspeaker installing frame 5. The loudspeaker installing frame 5 is mounted to the rotation support 3 via the supporting arm. On one hand, the loudspeaker installing frame 5 is mounted to the supporting arm by shaft coupling; for example, a mounting hole is provided in the supporting arm, a rotation shaft is provided at the loudspeaker installing frame 5, and the shaft coupling between the loudspeaker installing frame 5 and the rotation support 3 is realized by the feting of the mounting hole and the rotation shaft. On the other hand, the elevator motor 2 is provided on the rotation support 3, an axle 51 is provided at a boundary frame of the loudspeaker installing frame 5 that is opposite to the opening position of the loudspeaker, and a telescopic arm of the elevator motor 2 is connected to the axle 51, to realize the rotary connection between the loudspeaker installing frame 5 and telescopic arm of the elevator motor 2.

Figure 3:
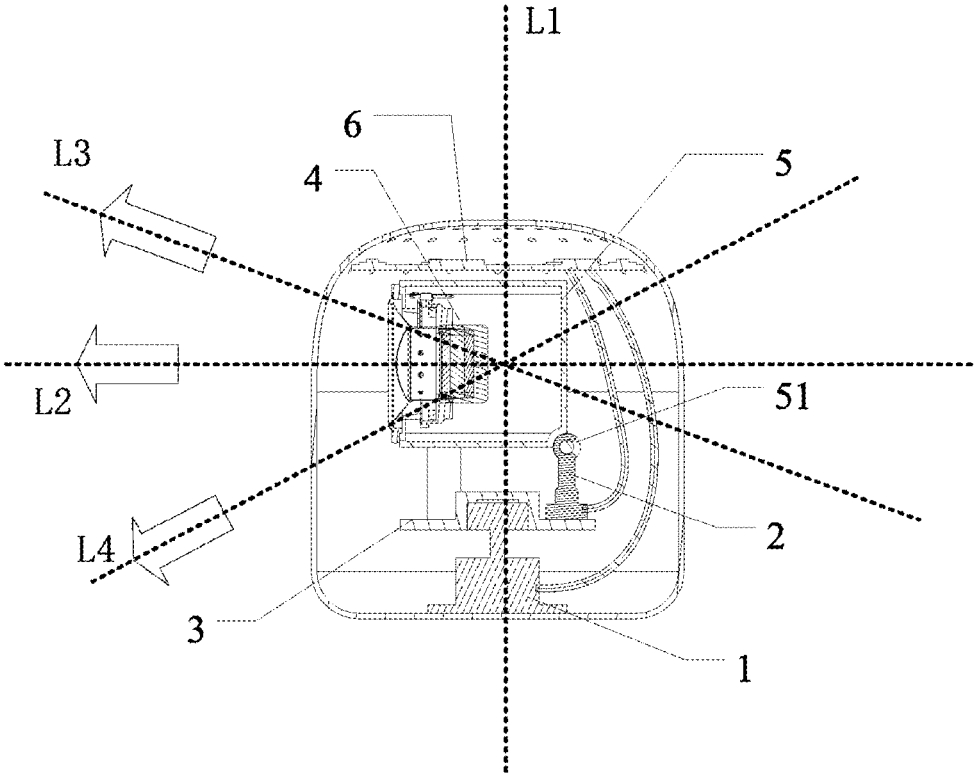
FIG. 3 is a schematic diagram of the center position of the audio device according to an embodiment of the present disclosure.

As shown in FIG. 3, the audio device according to the present embodiment further comprises a PCBA board 6, on which components such as the spherical microphone array, a CPU and a motor driving chip are integrated. As shown in FIG. 1, a sound-emission port is provided at the position of the top cover of the audio device that corresponds to the microphone, to enable the microphone to pick up external sound signals.

As shown in FIG. 4, the opening position of the loudspeaker is the center position of the opening of the loudspeaker. In the process of the designing of the audio device, it is designed in the present embodiment that the center position of the audio device is located on the space vertical central line of the audio device. As shown in FIG. 3, the L1 in FIG. 3 represents the space vertical central line of the audio device, wherein when the audio device is of a cylindrical structure, the space vertical central line of the audio device is the central axis of the cylinder; and the L2-L4 represent the opening direction in three different directions of the loudspeaker respectively, wherein when the opening direction of the loudspeaker is any one of the directions, the connecting lines between the opening positions of the loudspeaker and the center position of the audio device always intersect at the same one point.

In the present embodiment, the CPU, according to the sound signal picked up by the microphone in the spherical microphone array and the position of the microphone in the audio device, determines the spatial position of the sound-emission sound source of the user; according to the relationship among the spatial position of the sound-emission sound source of the user, the center position of the audio device and the opening position of the loudspeaker, determines the horizontal compensatory angle and the vertical compensatory angle of the opening direction of the loudspeaker relative to the spatial position of the user, the CPU generates the corresponding controlling instruction and sends to the motor driving chip, and the motor driving chip according to the horizontal compensatory angle and the vertical compensatory angle, and controls the rotation motor and the elevator motor according to the controlling instruction, so that the horizontal compensatory angle and the vertical compensatory angle are made to be zero, and adjusting the opening direction of the loudspeaker, to enable the opening direction of the loudspeaker to be aligned with the position of the user, to ensure that the user is within the area of the optimum sound effect of the audio device.

An aspect of the present disclosure provides a method for directional sound emission of an audio device.

The audio device according to the present embodiment comprises a built-in loudspeaker whose opening direction is adjustable, and a spherical microphone array. The spherical microphone array comprises a plurality of microphones that are spherically disposed. The structure of the audio device according to the present embodiment may refer to the audio device described above.

Figure 5:
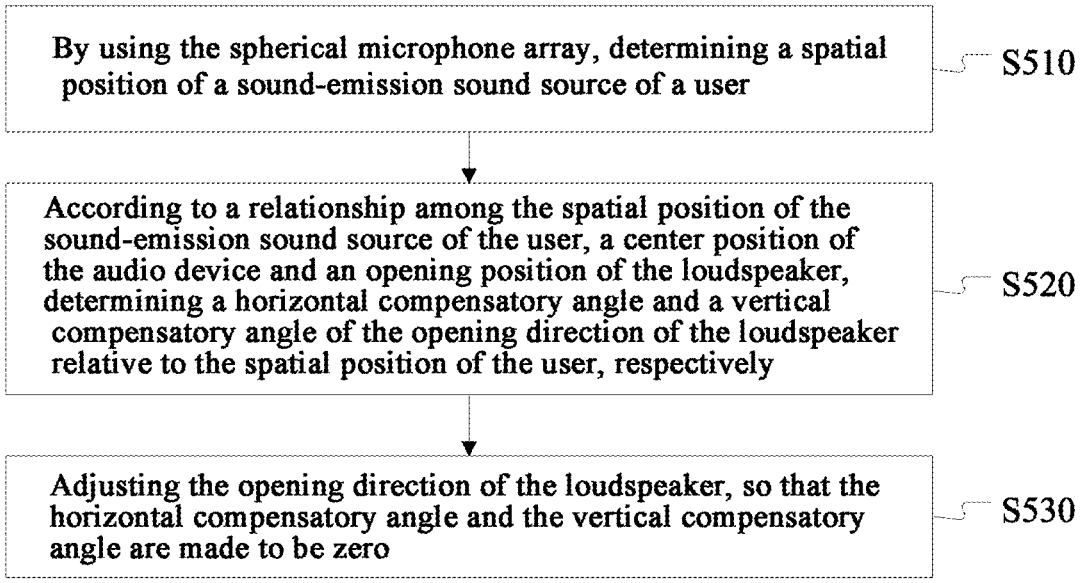
FIG. 5 is a flow chart of the method for directional sound emission of an audio device according to an embodiment of the present disclosure.

FIG. 5 is a flow chart of the method for directional sound emission of an audio device according to an embodiment of the present disclosure. As shown in FIG. 5, the method according to the present embodiment comprises:

S510: by using the spherical microphone array, determining a spatial position of a sound-emission sound source of a user.

S520: according to a relationship among the spatial position of the sound-emission sound source of the user, a center position of the audio device and an opening position of the loudspeaker, determining a horizontal compensatory angle and a vertical compensatory angle of the opening direction of the loudspeaker relative to the spatial position of the user respectively.

S530: adjusting the opening direction of the loudspeaker, so that the horizontal compensatory angle and the vertical compensatory angle are made to be zero.

The present embodiment, by using the spherical microphone array, can determine the spatial position of the sound-emission sound source of the user; based on the position relationship among the spatial position of the sound-emission sound source of the user, the center position of the audio device and the opening position of the loudspeaker, can determine the horizontal compensatory angle and the vertical compensatory angle of the opening direction of the loudspeaker relative to the spatial position of the user; and by adjusting the opening direction of the loudspeaker, so that the two compensatory angles are made to be zero, can realize the adjustment of the two degrees of freedom of the loudspeaker, which enables the opening direction of the loudspeaker to be aligned with the spatial position of the user in real time and accurately, and ensures that the user is within the area of the optimum sound effect of the audio device, thereby improving the acoustic experience of the user.

Figure 6:
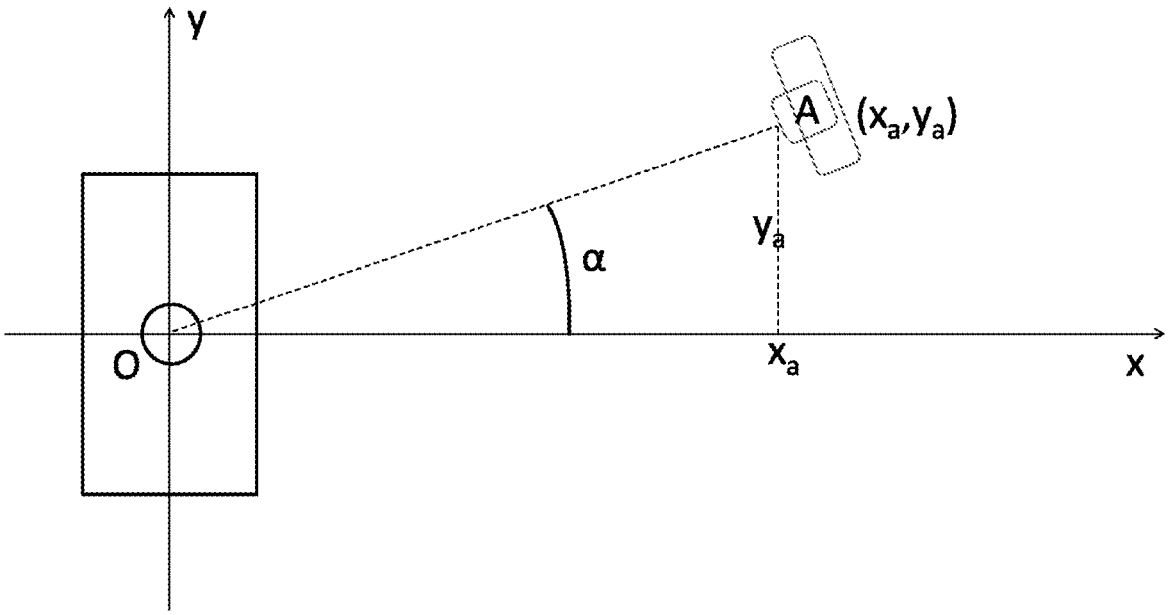
FIG. 6 is a schematic diagram of the rectangular plane coordinate system according to an embodiment of the present disclosure.
Figure 7:
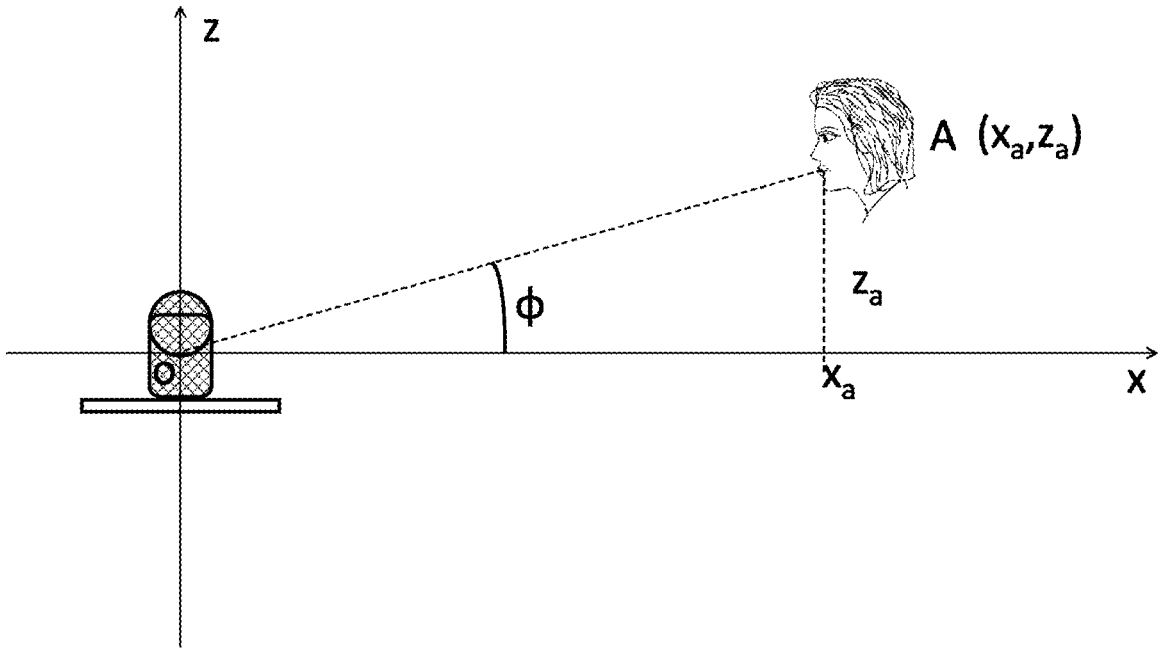
FIG. 7 is a schematic diagram of the rectangular vertical coordinate system according to an embodiment of the present disclosure.
Figure 8:
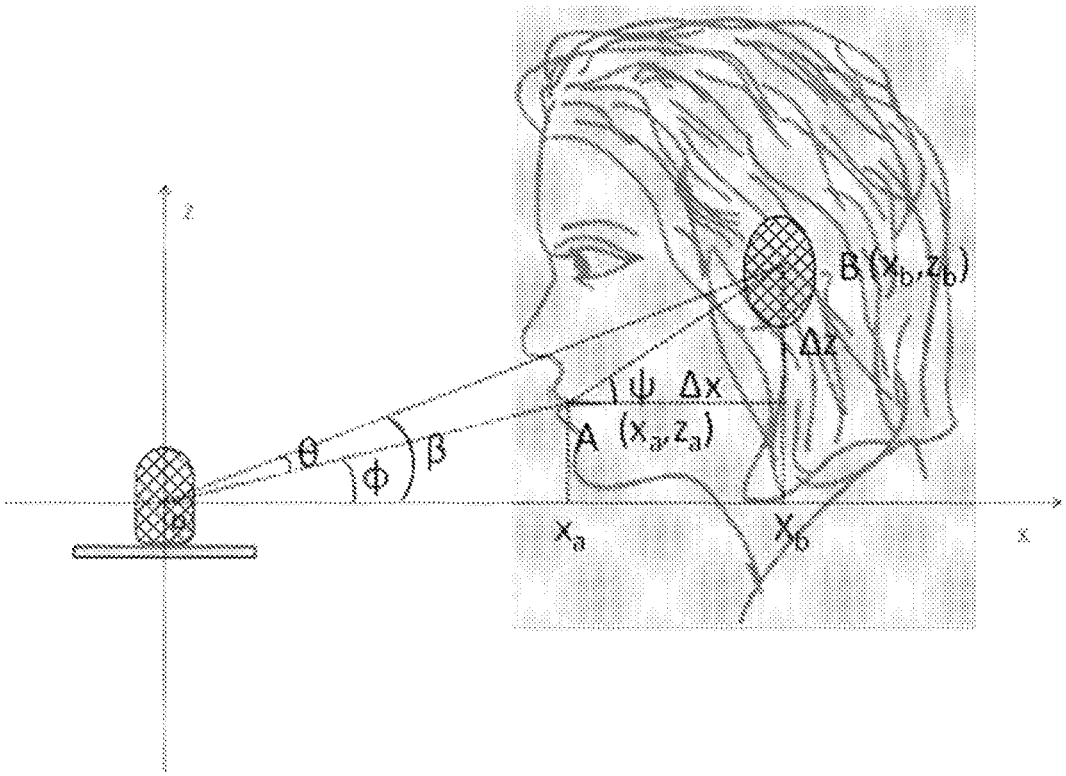
FIG. 8 is a schematic diagram of the vertical position coordinate of the spatial position of the ear of the user according to an embodiment of the present disclosure.

FIG. 6 is a schematic diagram of the rectangular plane coordinate system according to an embodiment of the present disclosure. FIG. 7 is a schematic diagram of the rectangular vertical coordinate system according to an embodiment of the present disclosure. FIG. 8 is a schematic diagram of the vertical position coordinate of the spatial position of the ear of the user according to an embodiment of the present disclosure. The steps S510-S530 will be described in detail below with reference to FIGS. 6-8.

Firstly, the step S510 is performed, i.e., by using the spherical microphone array, determining a spatial position of a sound-emission sound source of a user.

In an embodiment, the spatial position of the sound-emission sound source of the user may be determined in the following manner:

Firstly, a sound-source locating model is established in advance, wherein the sound-source locating model comprises a first distance parameter, a second distance parameter and a third distance parameter, wherein the first distance parameter includes respective distances from the sound source to the two microphones in the horizontal plane, the second distance parameter includes respective distances from the sound source to the two microphones in the vertical plane, and the third distance parameter includes the distance between the two microphones in the horizontal plane and the distance between the two microphones in the vertical plane.

Figure 2:
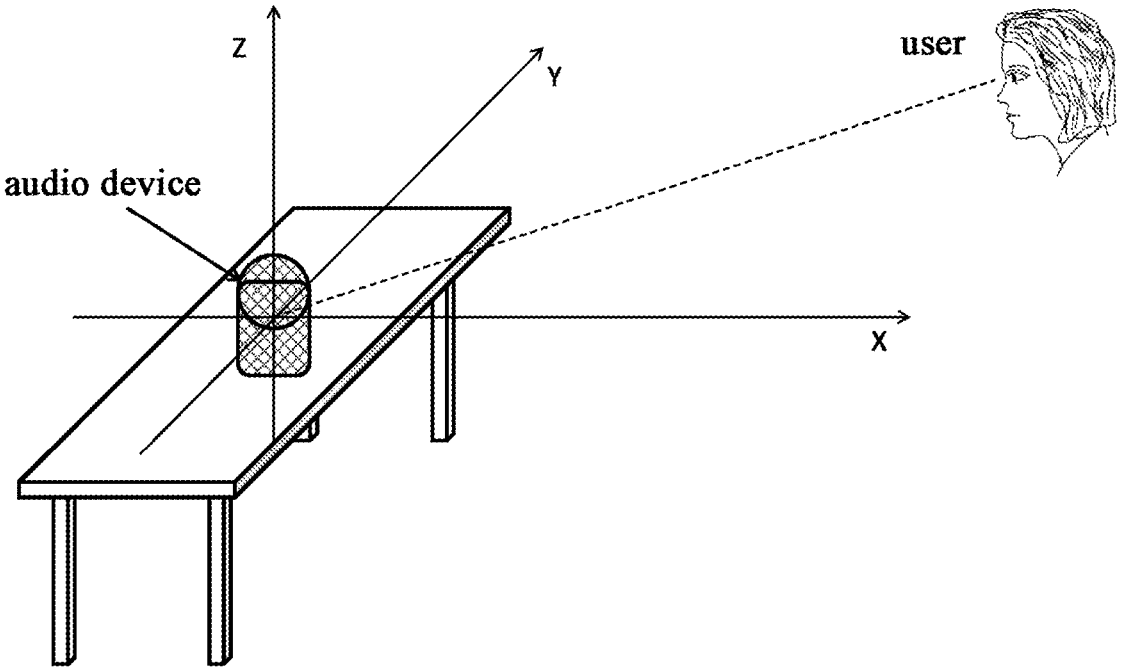
FIG. 2 is a schematic diagram in which the loudspeaker of the audio device according to an embodiment of the present disclosure faces the user.

As shown in FIG. 2, a space rectangular coordinate system may be established by using the center position of the audio device as the origin of coordinates, using the opening direction of the loudspeaker as the x-axis, and using the direction perpendicular to the opening direction of the loudspeaker as the y-axis. By using the at least two microphones located in the same one plane, the position of the sound source in that plane can be located. Therefore, the position of the sound source in the horizontal plane can be located by using the microphones in the spherical microphone array that are located in the same one horizontal plane, and the position of the sound source in the vertical plane can be located by using the microphone in the spherical microphone array that is perpendicular to the horizontal plane. Therefore, the spatial coordinates of the position of the sound-emission sound source can be accurately located.

Subsequently, the microphones in the spherical microphone array that receive sound signals that satisfy preset conditions are determined as the first microphones and second microphones, wherein the first microphones include two microphones that are parallel in the horizontal direction, and the second microphones include two microphones that are parallel in the vertical direction, wherein the two microphones in the spherical microphone array and located in the same one horizontal plane that receive the sound signals having the highest intensities are determined as the first microphones, and the two microphones in the spherical microphone array and located in the same one vertical plane that receive the sound signals having the highest intensities are determined as the second microphones.

Subsequently, the distances from the sound-emission sound source of the user to each of the microphones of the first microphones and the second microphones are acquired, and according to the position coordinates in the space rectangular coordinate system of each of the microphones in the spherical microphone array, the distance between the two microphones of the first microphones and the distance between the two microphones of the second microphones are acquired; wherein, by using the differences between the intensity values of the sound signals of the sound-emission sound source that are received by each of the microphones of the first microphones and the second microphones and the intensity value of the sound signal of the sound-emission sound source of the user, obtaining the distances from the sound-emission sound source of the user to each of the microphones of the first microphones and the second microphones; wherein, by using a diastimeter provided at the opening of the loudspeaker, measuring the distance between the sound-emission sound source of the user and the opening of the loudspeaker, and according to the position coordinates of each of the microphones and the distances between the sound-emission sound source of the user and the opening of the loudspeaker, obtaining the distances from the sound-emission sound source of the user to each of the microphones of the first microphones and the second microphones.

Finally, by using the sound-source locating model established in advance, and according to the distances from the sound-emission sound source of the user to each of the microphones of the first microphones and the second microphones, and the distances between the two microphones of the first microphones and the two microphones of the second microphones, the position coordinates in the space rectangular coordinate system of the sound-emission sound source of the user are obtained.

After the spatial position of the sound-emission sound source of the user has been determined, the step S520 is performed, i.e., according to a relationship among the spatial position of the sound-emission sound source of the user, a center position of the audio device and an opening position of the loudspeaker, determining a horizontal compensatory angle and a vertical compensatory angle of the opening direction of the loudspeaker relative to the spatial position of the user, respectively.

In the present disclosure, to facilitate calculating the horizontal compensatory angle and the vertical compensatory angle of the opening direction of the loudspeaker relative to the spatial position of the user, the amount of calculation is reduced, and the calculating steps is reduced, in the present embodiment, it is preset that the opening direction of the loudspeaker comprises a direction of the opening position that is indicated by a first connecting line between the center position of the audio device and the opening position of the loudspeaker; wherein the center position of the audio device is located on a space vertical central line of the audio device. Referring to FIG. 3, when the opening direction of the loudspeaker is facing the due left, the connecting line between the center position of the audio device (i.e., the position of the intersection point of the L1-L4) and the opening position of the loudspeaker, when facing the due left, is set to be the first connecting line. In other words, when the opening direction of the loudspeaker is facing the due left, the L2 is the first connecting line; when the opening direction of the loudspeaker is facing the top left, the L3 is the first connecting line; and when the opening direction of the loudspeaker is facing the bottom left, the L4 is the first connecting line.

The spatial position of the sound-emission sound source of the user comprises the spatial position of the mouth of the user. When determining the horizontal compensatory angle of the opening direction of the loudspeaker relative to the spatial position of the user, the method may comprise determining the horizontal compensatory angle of the opening direction of the loudspeaker relative to the spatial position of the sound-emission sound source of the user, adjusting the opening direction of the loudspeaker, so that the horizontal compensatory angle is made to be zero. When determining the vertical compensatory angle of the opening direction of the loudspeaker relative to the spatial position of the user, the method may comprise determining the vertical compensatory angle of the opening direction of the loudspeaker relative to the spatial position of the sound-emission sound source of the user and/or a spatial position of an ear of the user, and adjusting the opening direction of the loudspeaker, so that the vertical compensatory angle is made to be zero.

Because the sound-emission sound source of the user is generally the mouth of the user, and the direction of the mouth of the user is the direction of the two ears of the user, the method may comprise, by determining the horizontal compensatory angle to be the angle of the opening direction of the loudspeaker relative to the spatial position of the sound-emission sound source of the user, and by adjusting the horizontal compensatory angle to be zero, rendering the opening of the loudspeaker face the direction of the sound-emission sound source of the user, i.e., towards the two ears of the user, and making the opening direction of the loudspeaker towards the two ears of the user in the horizontal direction; and by determining the vertical compensatory angle to be the angle of the opening direction of the loudspeaker relative to the spatial position of the sound-emission sound source of the user (or the ears of the user), and by adjusting the vertical compensatory angle to be zero, rendering the opening direction of the loudspeaker towards the spatial position of the sound-emission sound source of the user (or the two ears of the user) in the vertical direction.

In an embodiment, the horizontal compensatory angle of the opening direction of the loudspeaker relative to the spatial position of the user is determined in the following manner: determining the horizontal compensatory angle of the opening direction of the loudspeaker relative to the spatial position of the sound-emission sound source of the user, adjusting the opening direction of the loudspeaker, so that the horizontal compensatory angle is made to be zero.

As shown in FIG. 6, the method for calculating the horizontal compensatory angle comprises: establishing a rectangular plane coordinate system with the center position of the audio device as an origin, wherein the x-axis of the established rectangular plane coordinate system is the straight line where the connecting line between the opening position of the loudspeaker and the center position of the audio device is located; by using the spherical microphone array, determining a horizontal position coordinate of the spatial position of the sound-emission sound source of the user, which means that, by using the sound-source locating model described above, the horizontal position coordinate (Xa, Ya) of the sound-emission sound source of the user in the XOY plane can be determined; and according to a second connecting line between the horizontal position coordinate and the center position of the audio device together with the first connecting line, forming the horizontal compensatory angle in the rectangular plane coordinate system, and referring to FIG. 6, determining the included angle $\alpha$ formed by the connecting line between the point of the horizontal position coordinate of the sound-emission sound source of the user and the origin of coordinates, and the x-axis to be the horizontal compensatory angle shown in FIG. 6.

In another embodiment, the vertical compensatory angle of the opening direction of the loudspeaker relative to the spatial position of the user is determined in the following manner: determining the vertical compensatory angle of the opening direction of the loudspeaker relative to the spatial position of the sound-emission sound source of the user and/or a spatial position of an ear of the user, i.e., determining the vertical compensatory angle of the opening direction of the loudspeaker relative to the spatial position of the sound-emission sound source of the user, or determining the vertical compensatory angle of the opening direction of the loudspeaker relative to the spatial position of the ear of the user; and adjusting the opening direction of the loudspeaker, so that the vertical compensatory angle is made to be zero.

As shown in FIG. 7, when the vertical compensatory angle comprises the angle of the opening direction of the loudspeaker relative to the spatial position of the sound-emission sound source of the user, the method for calculating the vertical compensatory angle comprises: establishing a rectangular vertical coordinate system with the center position of the audio device as an origin, wherein the x-axis of the established rectangular vertical coordinate system is the straight line where the connecting line between the opening position of the loudspeaker and the center position of the audio device is located, or in other words, is the XOZ plane in the space rectangular coordinate system shown in FIG. 2; by using the spherical microphone array, determining a vertical position coordinate of the spatial position of the sound-emission sound source of the user as a first vertical coordinate, wherein, by using the sound-source locating model described above, the first vertical position coordinate (Xa, Za) of the sound-emission sound source of the user in the XOZ plane can be determined; and according to a third connecting line between the first vertical coordinate and the center position of the audio device together with the first connecting line, forming the vertical compensatory angle in the rectangular vertical coordinate system as a first vertical compensatory angle, and referring to FIG. 7, determining the included angle $\phi$ formed by the connecting line between the point A of the first vertical position coordinate of the sound-emission sound source of the user and the origin of coordinates and the x-axis as the first vertical compensatory angle shown in FIG. 7.

When the vertical compensatory angle comprises the angle of the opening direction of the loudspeaker relative to the spatial position of the ear of the user, the method for calculating the vertical compensatory angle comprises: according to a first vertical position coordinate of the spatial position of the sound-emission sound source of the user, and a preset distance and/or angle relation in the rectangular vertical coordinate system between the spatial position of the ear of the user and the spatial position of the sound-emission sound source, determining the vertical position coordinate of the spatial position of the ear of the user as a second vertical coordinate; according to the third connecting line between the first vertical coordinate and the center position of the audio device together with a fourth connecting line between the second vertical coordinate and the center position of the audio device, forming a difference vertical compensatory angle as a second vertical compensatory angle; and adjusting the opening direction of the loudspeaker, so that a sum of the first vertical compensatory angle and the second vertical compensatory angle is made to be zero.

As shown in FIG. 8, according to the method shown in FIG. 7, the first vertical coordinate (Xa, Za) of the spatial position A of the sound-emission sound source of the user may be calculated. When the preset distance and/or angle relation in the rectangular vertical coordinate system between the spatial position of the ear of the user and the spatial position of the sound-emission sound source includes the distance relation in the rectangular vertical coordinate system between the spatial position of the ear of the user and the spatial position of the sound-emission sound source, for example, when the distance relation includes the $\Delta X$ and the $\Delta Z$ shown in FIG. 8, according to the first vertical coordinate (Xa, Za) and the $\Delta X$ and the $\Delta Z$, the second vertical coordinate (Xb, Zb) of the spatial position B of the ear of the user can be obtained. Alternatively, when the distance relation includes the angle w and the distance $\Delta X$ (or the distance $\Delta Z$) between the connecting line between the mouth and the ear and the relative horizontal direction shown in FIG. 8, according to the first vertical coordinate (Xa, Za) and the angle w and the distance ΔX (or the distance ΔZ), the second vertical coordinate (Xb, Zb) of the spatial position B of the ear of the user can be obtained. The included angle between the connecting line between the point B of the second vertical coordinate of the spatial position of the ear of the user and the origin of coordinates and the connecting line between the point A of the first vertical coordinate of the spatial position of the sound-emission sound source of the user and the origin of coordinates, as shown in FIG. 8, is determined as the second vertical compensatory angle θ, and by adjusting the opening direction of the loudspeaker, the sum of the first vertical compensatory angle ϕ and the second vertical compensatory angle θ (i.e., the angle β) is made to be zero, which makes the opening direction of the loudspeaker to be aligned with the ear of the user in the vertical direction, thereby improving the accuracy of the directional sound emission of the loudspeaker.

After the horizontal compensatory angle and the vertical compensatory angle of the opening direction of the loudspeaker relative to the spatial position of the user have been determined, the step S530 is performed, i.e., adjusting the opening direction of the loudspeaker, so that the horizontal compensatory angle and the vertical compensatory angle are made to be zero.

In combination with the audio device shown in FIG. 3, by using the rotation motor and the elevator motor, this step can adjust the opening direction of the loudspeaker, to realize the adjustment of the two degrees of freedom of the opening direction of the loudspeaker, i.e., the vertical angle corresponding to the pitching direction of the audio device and the horizontal angle corresponding to the rotation direction of the audio device, to achieve the object of accurately controlling the directional sound emission of the loudspeaker, thereby improving the acoustic experience of the user.

Another aspect of the present disclosure provides an apparatus for directional sound emission of an audio device.

The audio device according to the present embodiment comprises a built-in loudspeaker whose opening direction is adjustable and a spherical microphone array. The spherical microphone array comprises a plurality of microphones that are spherically disposed.

Figure 9:
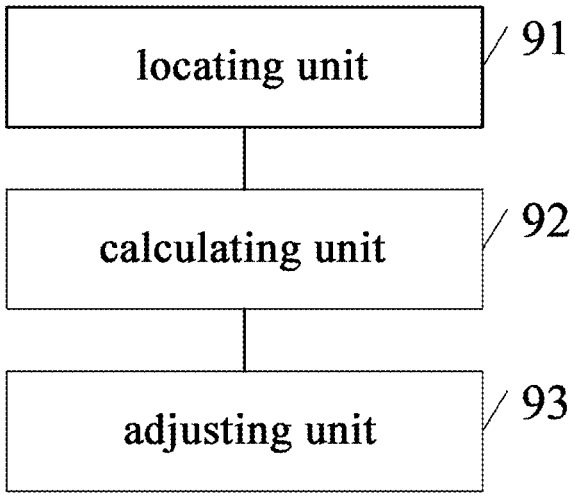
FIG. 9 is a structural block diagram of the apparatus for directional sound emission of an audio device according to an embodiment of the present disclosure.

FIG. 9 is a structural block diagram of the apparatus for directional sound emission of an audio device according to an embodiment of the present disclosure. As shown in FIG. 9, the apparatus according to the present embodiment comprises:

a locating unit 91 configured for, by using the spherical microphone array, determining a spatial position of a sound-emission sound source of a user;

a calculating unit 92 configured for, according to a relationship among the spatial position of the sound-emission sound source of the user, a center position of the audio device and an opening position of the loudspeaker, determining a horizontal compensatory angle and a vertical compensatory angle of the opening direction of the loudspeaker relative to the spatial position of the user respectively; and an adjusting unit 93 configured for adjusting the opening direction of the loudspeaker, so that the horizontal compensatory angle and the vertical compensatory angle are made to be zero.

The apparatus for directional sound emission according to the present embodiment, by using the locating unit to drive the spherical microphone array, can accurately determine the spatial position of the sound-emission sound source of the user; by using the calculating unit, based on the position relationship among the spatial position of the sound-emission sound source of the user, the center position of the audio device and the opening position of the loudspeaker, can determine the horizontal compensatory angle and the vertical compensatory angle of the opening direction of the loudspeaker relative to the spatial position of the user; and by adjusting the opening direction of the loudspeaker with the adjusting unit, the two compensatory angles are made to be zero, can realize the adjustment of the two degrees of freedom of the loudspeaker, which enables the opening direction of the loudspeaker to be aligned with the spatial position of the user in real time and accurately, and ensures that the user is within the area of the optimum sound effect of the audio device, thereby improving the acoustic experience of the user.

The opening direction of the loudspeaker according to the present embodiment comprises a direction of the opening position that is indicated by a first connecting line between the center position of the audio device and the opening position of the loudspeaker, wherein the center position of the audio device is located on a space vertical central line of the audio device; and the spatial position of the sound-emission sound source comprises a spatial position of a mouth of the user.

In an embodiment, the calculating unit 92 is configured for determining the horizontal compensatory angle of the opening direction of the loudspeaker relative to the spatial position of the sound-emission sound source of the user, and the adjusting unit 93 is configured for adjusting the opening direction of the loudspeaker, so that the horizontal compensatory angle is made to be zero.

The calculating unit 92 is particularly configured for establishing a rectangular plane coordinate system with the center position of the audio device as an origin; by using the spherical microphone array, determining a horizontal position coordinate of the spatial position of the sound-emission sound source of the user; and according to a second connecting line between the horizontal position coordinate and the center position of the audio device together with the first connecting line, forming the horizontal compensatory angle in the rectangular plane coordinate system.

In another embodiment, the calculating unit 92 is configured for determining the vertical compensatory angle of the opening direction of the loudspeaker relative to the spatial position of the sound-emission sound source of the user and/or a spatial position of an ear of the user; and the adjusting unit 93 is configured for adjusting the opening direction of the loudspeaker, so that the vertical compensatory angle is made to be zero.

When the vertical compensatory angle comprises the angle of the opening direction of the loudspeaker relative to the spatial position of the sound-emission sound source of the user, the calculating unit 92 is particularly configured for establishing a rectangular vertical coordinate system with the center position of the audio device as an origin; by using the spherical microphone array, determining a vertical position coordinate of the spatial position of the sound-emission sound source of the user as a first vertical coordinate; and according to a third connecting line between the first vertical coordinate and the center position of the audio device together with the first connecting line, forming the vertical compensatory angle in the rectangular vertical coordinate system as a first vertical compensatory angle.

When the vertical compensatory angle comprises the angle of the opening direction of the loudspeaker relative to the spatial position of the ear of the user, the calculating unit 92 is particularly configured for, according to a first vertical position coordinate of the spatial position of the sound-emission sound source of the user, and a preset distance and/or angle relation in the rectangular vertical coordinate system between the spatial position of the ear of the user and the spatial position of the sound-emission sound source, determining the vertical position coordinate of the spatial position of the ear of the user as a second vertical coordinate; according to the third connecting line between the first vertical coordinate and the center position of the audio device together with a fourth connecting line between the second vertical coordinate and the center position of the audio device, forming a difference vertical compensatory angle as a second vertical compensatory angle; and adjusting the opening direction of the loudspeaker, so that a sum of the first vertical compensatory angle and the second vertical compensatory angle is made to be zero.

Regarding the device embodiments, because they basically correspond to the process embodiments, the relative parts may refer to the description on the process embodiments. The above-described device embodiments are merely illustrative, wherein the units that are described as separate components may or may not be physically separate, and the components that are displayed as units may or may not be physical units; in other words, they may be located at the same one location, and may also be distributed to a plurality of network units. Part or all of the modules may be selected according to the actual demands to realize the purposes of the solutions of the embodiments. A person skilled in the art can understand and implement the technical solutions without paying creative work.

Another aspect of the present disclosure provides an audio device.

Figure 10:
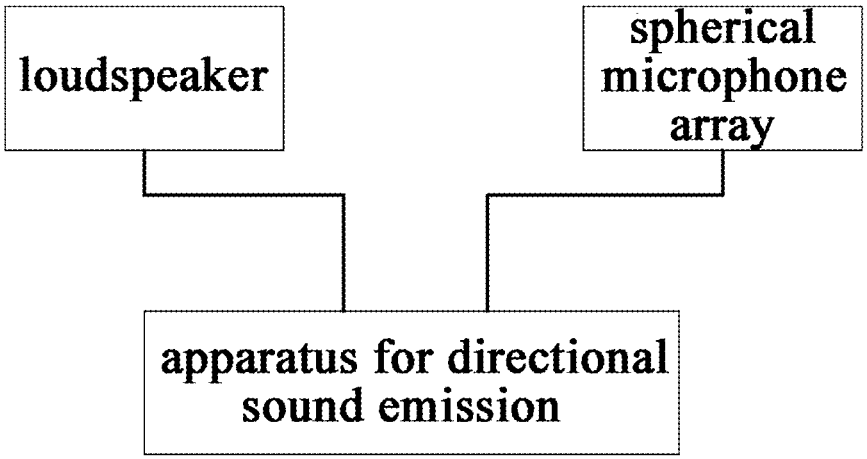
FIG. 10 is a structural block diagram of the audio device according to an embodiment of the present disclosure.

FIG. 10 is a structural block diagram of the audio device according to an embodiment of the present disclosure. As shown in FIG. 10, the audio device comprises a built-in loudspeaker whose opening direction is adjustable, and a spherical microphone array. The spherical microphone array comprises a plurality of microphones that are spherically disposed. The audio device further comprises a processor and a machine-readable storage medium that stores a machine-executable instruction, and by reading and executing the machine-executable instruction in the machine-readable storage medium, the processor is able to implement the method for directional sound emission of an audio device described above.

The audio device according to the present embodiment, by using the spherical microphone array, can accurately determine the spatial position of the sound-emission sound source of the user; based on the position relationship among the spatial position of the sound-emission sound source of the user, the center position of the audio device and the opening position of the loudspeaker, can determine the horizontal compensatory angle and the vertical compensatory angle of the opening direction of the loudspeaker relative to the spatial position of the user; and by adjusting the opening direction of the loudspeaker, so that the two compensatory angles are made to be zero, can realize the adjustment of the two degrees of freedom of the loudspeaker, which enables the opening direction of the loudspeaker to be aligned with the spatial position of the user in real time and accurately, and ensures that the user is within the area of the optimum sound effect of the audio device, thereby improving the acoustic experience of the user.

Referring to FIG. 3, the audio device according to the present embodiment comprises a rotation motor and an elevator motor. A loudspeaker installing frame installed with the loudspeaker is rotatably installed on a rotation support. The rotation support is rotatably installed on the rotation motor, and the rotation motor drives the rotation support to rotate, to drive the loudspeaker installing frame to rotate, to realize the rotation of the loudspeaker in the horizontal direction. The elevator motor is installed on the rotation support. A telescopic arm of the elevator motor is rotatably connected to an axle of the loudspeaker installing frame. The axle is provided at a boundary-frame position of the loudspeaker installing frame that is opposite to the opening position of the loudspeaker. The elevator motor drives the loudspeaker installing frame to rotate vertically, to realize the rotation of the loudspeaker in the vertical direction. By adjusting the two degrees of freedom of the loudspeaker, the system can accurately control the loudspeaker to directionally emit sound, to enable the loudspeaker to be aligned with the ears of the user, which ensures that the user is in real time within the area of the optimum sound effect of the audio device, thereby improving the acoustic experience of the user.

Figure 11:
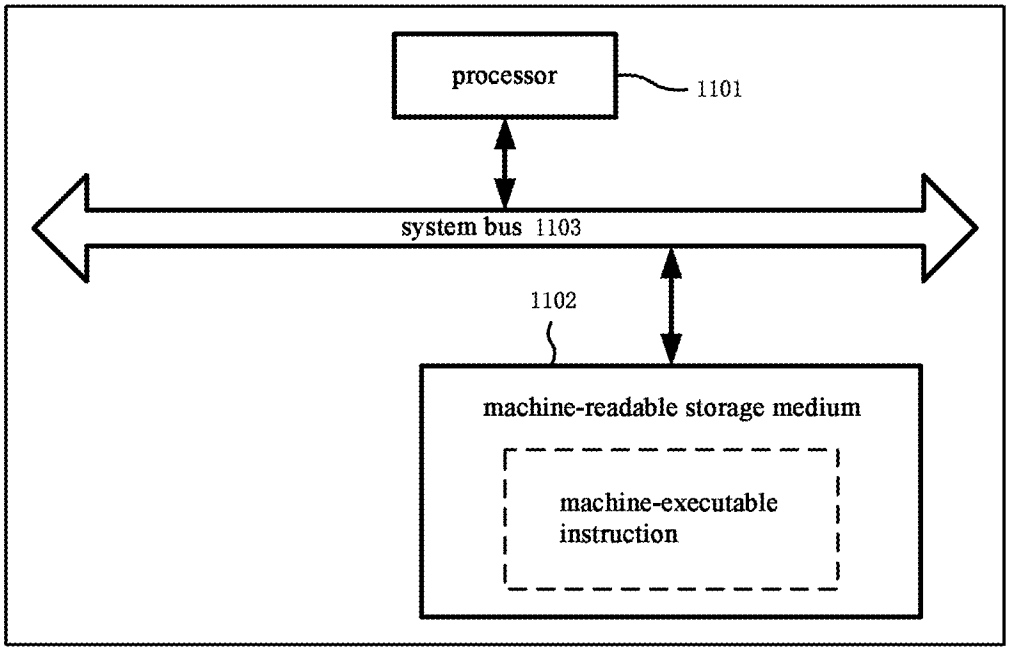
FIG. 11 is a schematic diagram of the hardware structure of the system according to an embodiment of the present disclosure.

The system according to the present application may be implemented by software, and may also be implemented by hardware or a combination of software and hardware. Taking the software implementation as an example, referring to FIG. 11, the system according to the present application may comprise a processor 1101 and a machine-readable storage medium 1102 that stores a machine-executable instruction. The processor 1101 and the machine-readable storage medium 1102 may communicate via a system bus 1103. Furthermore, by reading and executing the machine-executable instruction in the machine-readable storage medium 1102 that corresponds to the logic of the directional sound emission of the audio device, the processor 1101 can implement the method for directional sound emission of an audio device described above.

Another aspect of the present disclosure provides a machine-readable storage medium.

The machine-readable storage medium according to the embodiment of the present disclosure stores a machine-executable instruction, and the machine-executable instruction, when executed by a processor, implements the method for directional sound emission of an audio device stated above.

It should be noted that the readable storage medium according to the embodiment of the present disclosure may, for example, be any medium that can contain, store, transmit, propagate or transport the instruction. For example, the readable storage medium may include but is not limited to an electric, magnetic, optical, electromagnetic, infrared or semiconductor system, apparatus, device or propagation medium. Particular examples of the readable storage medium include: a magnetic storage device, such as a magnetic tape or a hard disk (HDD); an optical storage device, such as an optical disc (CD-ROM); a memory, such as a random access memory (RAM) or a flash memory; and/or a wired/wireless communication link.

The machine-readable storage medium may contain a computer program, and the computer program may contain a code/computer-executable instruction, which, when executed by a processor, causes the processor to implement, for example, the process of the method for directional sound emission of an audio device described above and any equivalent thereof.

The computer program may be configured to have a computer program code containing, for example, a computer program module. For example, in an exemplary embodiment, the code in the computer program may comprise one or more program modules. It should be noted that the division manner and the quantity of the modules are not fixed, and a person skilled in the art can use suitable program modules or a combination of program modules according to actual conditions. When the combination of those program modules is executed by a processor, the processor can implement, for example, the process of the method for directional sound emission of an audio device described above and any equivalent thereof.

In order to facilitate the clear description of the technical solutions of the embodiments of the present disclosure, in the embodiments of the present disclosure, terms such as "first" and "second" are used to distinguish identical items or similar items that have substantially the same functions and effects, and a person skilled in the art can understand that the terms such as "first" and "second" do not limit the quantity and the execution order.

The above are merely particular embodiments of the present disclosure. By the teaching of the present disclosure, a person skilled in the art can make other modifications or variations on the basis of the above embodiments. A person skilled in the art should understand that the above particular descriptions are only for the purpose of better interpreting the present disclosure, and the protection scope of the present disclosure should be determined by the protection scope of the claims.

While at least one exemplary embodiment has been presented in the foregoing detailed description, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment, it being understood that various changes may be made in the function and arrangement of elements described in an exemplary embodiment without departing from the scope of the invention as set forth in the appended claims and their legal equivalents.

The invention claimed is:

1. A method for directional sound emission of an audio device, wherein the audio device comprises a built-in loudspeaker whose opening direction is adjustable and a spherical microphone array, and the method comprises:

by using the spherical microphone array, determining a spatial position of a sound-emission sound source of a user;

according to a relationship among the spatial position of the sound-emission sound source of the user, a center position of the audio device and an opening position of the loudspeaker, determining a horizontal compensatory angle and a vertical compensatory angle of the opening direction of the loudspeaker relative to the spatial position of the user, respectively; and adjusting the opening direction of the loudspeaker, so that the horizontal compensatory angle and the vertical compensatory angle are made to be zero, wherein the opening direction of the loudspeaker comprises a direction of the opening position that is indicated by a first connecting line between the center position of the audio device and the opening position of the loudspeaker; and wherein the center position of the audio device is located on a space vertical central line of the audio device, the determining the horizontal compensatory angle and the vertical compensatory angle of the opening direction of the loudspeaker relative to the spatial position of the user respectively comprises:

determining the vertical compensatory angle of the opening direction of the loudspeaker relative to the spatial position of the sound-emission sound source of the user and/or a spatial position of an ear of the user; and adjusting the opening direction of the loudspeaker, so that the vertical compensatory angle is made to be zero, the determining the vertical compensatory angle of the opening direction of the loudspeaker relative to the spatial position of the sound-emission sound source of the user and/or the spatial position of the ear of the user comprises:

establishing a rectangular vertical coordinate system with the center position of the audio device as an origin;

by using the spherical microphone array, determining a vertical position coordinate of the spatial position of the sound-emission sound source of the user as a first vertical coordinate; and according to a third connecting line between the first vertical coordinate and the center position of the audio device together with the first connecting line, forming the vertical compensatory angle in the rectangular vertical coordinate system as a first vertical compensatory angle;

the determining the vertical compensatory angle of the opening direction of the loudspeaker relative to the spatial position of the sound-emission sound source of the user and/or the spatial position of the ear of the user further comprises:

according to a first vertical position coordinate of the spatial position of the sound-emission sound source of the user, and a preset distance and/or angle relation in the rectangular vertical coordinate system between the spatial position of the ear of the user and the spatial position of the sound-emission sound source, determining the vertical position coordinate of the spatial position of the ear of the user as a second vertical coordinate;

according to the third connecting line between the first vertical coordinate and the center position of the audio device together with a fourth connecting line between the second vertical coordinate and the center position of the audio device, forming a difference vertical compensatory angle as a second vertical compensatory angle; and adjusting the opening direction of the loudspeaker, so that a sum of the first vertical compensatory angle and the second vertical compensatory angle is made to be zero.

2. The method according to claim 1, wherein the spatial position of the sound-emission sound source comprises a spatial position of a mouth of the user.

3. The method according to claim 1, wherein the determining the horizontal compensatory angle and the vertical compensatory angle of the opening direction of the loudspeaker relative to the spatial position of the user respectively comprises:

determining the horizontal compensatory angle of the opening direction of the loudspeaker relative to the spatial position of the sound-emission sound source of the user, and adjusting the opening direction of the loudspeaker, so that the horizontal compensatory angle is made to be zero.

4. The method according to claim 3, wherein the determining the horizontal compensatory angle of the opening direction of the loudspeaker relative to the spatial position of the sound-emission sound source of the user comprises:

establishing a rectangular plane coordinate system with the center position of the audio device as an origin;

by using the spherical microphone array, determining a horizontal position coordinate of the spatial position of the sound-emission sound source of the user; and according to a second connecting line between the horizontal position coordinate and the center position of the audio device together with the first connecting line, forming the horizontal compensatory angle in the rectangular plane coordinate system.

5. An audio device, wherein the audio device comprises a built-in loudspeaker whose opening direction is adjustable, and a spherical microphone array, and further comprises a processor and a machine-readable storage medium that stores a machine-executable instruction, and, by reading and executing the machine-executable instruction in the machine-readable storage medium, the processor is able to implement the method for directional sound emission of an audio device according to claim 1.

6. A non-transitory machine-readable storage medium, wherein the machine-readable storage medium stores a machine-executable instruction, and the machine-executable instruction, when executed by a processor, implements the method for directional sound emission of an audio device according to claim 1.

* * * * *